US010928116B2

(12) United States Patent
McCollough et al.

(10) Patent No.: US 10,928,116 B2
(45) Date of Patent: Feb. 23, 2021

(54) MODULAR WATER STORAGE TANK FOR A REFRIGERATOR

(71) Applicant: Electrolux Home Products, Inc., Charlotte, NC (US)

(72) Inventors: Thomas McCollough, Anderson, SC (US); Keith Thomas Phelan, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 57 days.

(21) Appl. No.: 16/287,155

(22) Filed: Feb. 27, 2019

(65) Prior Publication Data

US 2020/0271367 A1 Aug. 27, 2020

(51) Int. Cl.
*F25D 17/02* (2006.01)

(52) U.S. Cl.
CPC ..... *F25D 17/02* (2013.01); *F25D 2323/122* (2013.01)

(58) Field of Classification Search
CPC ..... B01D 35/153; B01D 2201/303; B01D 2201/4023; B01D 35/147; C02F 1/003; C02F 2201/006; C02F 2301/043; C02F 2307/12; C02F 2201/005; F25D 23/126; F25D 2323/121; F25D 17/02; F25D 2323/122
USPC ..... 220/4.04, 4.06, 4.07, 4.21, 4.12, 592.01, 220/592.02, 592.16; 62/3.1, 3.2, 3.3, 3.6, 62/644, 648
See application file for complete search history.

(56) References Cited

U.S. PATENT DOCUMENTS 2,954,896 A * 10/1960 Russell ..... B01D 27/08 220/320
2,967,699 A * 1/1961 Brown ..... B01D 47/00 261/114.1
3,024,938 A * 3/1962 Watter ..... F17C 1/00 220/4.12
3,028,918 A * 4/1962 Huthsing, Sr. ..... A62C 13/003 169/82
4,434,903 A * 3/1984 Cooke ..... B65D 41/06 215/222
5,102,005 A * 4/1992 Trussler ..... B29C 63/18 220/4.12
D330,712 S * 11/1992 Pingel ..... D15/5
6,132,176 A * 10/2000 Higgins ..... B01D 25/005 417/46
6,200,692 B1 * 3/2001 Tamura ..... B01J 19/02 205/171

(Continued)

*Primary Examiner* — Kareen K Thomas
(74) *Attorney, Agent, or Firm* — Pearne & Gordon LLP

(57) ABSTRACT

A modular water storage tank, for a refrigerator, includes a hollow storage body comprising a first body member having first and second open ends, the first open end comprising a first male extension having a first connection member on an outer surface thereof. A female end cap comprises a second connection member on an inner surface thereof that is configured to engage with the first connection member to secure the female end cap to the first open end. A male end cap comprises a second male extension having a third connection member on an outer surface thereof that is configured to engage with a fourth connection member disposed on an inner surface at the second open end of the first body member to secure the male end cap to the second open end of the first body member.

18 Claims, 12 Drawing Sheets

(56) References Cited

U.S. PATENT DOCUMENTS 6,280,619 B1 * 8/2001 Lacy ..... B01D 24/001 210/232
6,325,929 B1 * 12/2001 Bassett ..... B01D 61/18 210/238
6,409,786 B1 * 6/2002 Wright ..... B01D 46/0004 55/317
7,287,663 B2 * 10/2007 Vandal ..... F17C 1/02 220/4.12
7,351,332 B2 * 4/2008 DeMarco ..... B01D 15/22 156/73.5
7,442,301 B2 * 10/2008 Huda ..... B01D 35/30 210/232
8,087,526 B2 * 1/2012 Dovey ..... B65D 11/06 220/4.08
8,425,773 B2 4/2013 Bonta et al.
8,580,109 B2 * 11/2013 Kruckenberg ..... B01D 35/30 210/232
8,696,900 B2 * 4/2014 DeMarco ..... B01D 15/22 210/198.2
8,726,685 B2 5/2014 An
8,869,550 B2 10/2014 Krause et al.
9,222,722 B2 12/2015 Kim et al.
9,631,859 B2 4/2017 Park
9,714,110 B2 7/2017 Veltrop et al.
9,914,076 B2 * 3/2018 Koreis ..... B01D 29/114
10,525,387 B2 * 1/2020 Campbell ..... B01D 35/153
2005/0279743 A1 * 12/2005 Lee ..... F17C 1/00 220/4.12
2006/0070942 A1 * 4/2006 An ..... C02F 9/005 210/433.1
2007/0017914 A1 * 1/2007 Shigesada ..... B01D 65/003 222/189.11
2007/0199876 A1 * 8/2007 Tubby ..... B01D 35/147 210/232
2007/0227959 A1 * 10/2007 Sinur ..... B01D 35/306 210/232
2008/0000820 A1 * 1/2008 Mitchell ..... B01D 35/147 210/141
2009/0321340 A1 * 12/2009 Rampen ..... B01D 35/153 210/233
2011/0174705 A1 * 7/2011 Branscomb ..... B01D 35/30 210/153
2018/0290083 A1 * 10/2018 Campbell ..... C02F 1/003
2019/0145237 A1 * 5/2019 Shampine ..... F04B 23/06 60/39.45

* cited by examiner

MODULAR WATER STORAGE TANK FOR A REFRIGERATOR

CROSS-REFERENCE TO RELATED APPLICATIONS

None

FIELD OF THE INVENTION

This application relates generally to a cold water storage tank for a refrigerator, and more particularly, a modular water storage tank within a refrigerator, the storage tank being reconfigurable to fit various geometries and/or water circuit layouts.

BACKGROUND OF THE INVENTION

Conventional refrigeration applications, such as domestic refrigerators, typically have a water storage tank provided therein to store a predetermined amount of water to be used in downstream operations (e.g., water dispensing, ice making, etc.). Typically, companies that manufacture refrigerators often have various different models being manufactured at a single time. As such, it is known to implement an individually designed water storage tank into each respective refrigerator model. This process is costly and inefficient.

In order to decrease cost and increase efficiency, water storage tanks are now universally designed to be installed in various refrigerator models. That is, a single water storage tank would be designed so as to be capable of being installed within a plurality of refrigerator models; each model having its own positioning and spatial considerations. Conventional water storage tank designs consist of cylindrical tanks, coiled tanks, and blow molded tanks. In each of these designs, a single water storage tank is capable of being installed within each of the plurality of refrigerator models and configured to hold a constrained volume of water, dependent on the shape and layout of said storage tank. However, having a universally designed water storage tank employed in separate models may decrease the overall efficiency of each respective water circuit assembly.

BRIEF SUMMARY OF THE INVENTION

In accordance with one aspect, there is provided a modular water storage tank for a refrigerator. The modular water storage tank is in fluid communication between an upstream source and a downstream destination provided at the refrigerator. The modular water storage tank comprises a hollow storage body including a first body member having first and second open ends that are axially spaced from one another along a longitudinal axis of the first body member. The first and second open ends face opposite directions with respect to one another, and the first open end comprises a first male extension that extends outwards and away from a central portion of the first body member. The first male extension has a first connection member on an outer surface thereof.

The modular water storage tank further comprises a female end cap including a side wall extending outwards and away from a front end wall. An inner surface of the side wall has a second connection member that is configured to engage with the first connection member to secure the female end cap to the first open end when the side wall surrounds the first male extension. Further, the modular water storage tank includes a male end cap comprising a second male extension extending outwards from a rear end wall. The second male extension has a third connection member on an outer surface thereof that is configured to engage with a fourth connection member disposed on an inner surface at the second open end of the first body member to secure the male end cap to the second open end of the first body member when the inner surface at the second open end surrounds the second male extension.

In accordance with another aspect, there is provided a modular water storage tank for a refrigerator. The modular water storage tank is in fluid communication between an upstream source and a downstream destination provided at the refrigerator. The modular water storage tank comprises a hollow storage body having first and second open ends that are axially spaced from one another along a longitudinal axis of the hollow storage body. The first and second open ends face opposite directions with respect to one another.

The modular water storage tank further comprises end caps that are secured to the first and second open ends of the hollow storage body to define an interior storage space within the hollow storage body for storing water therein. The end caps comprise a first pair of caps that permits the water to enter the hollow storage body via the second open end, and which permits the water to exit the hollow storage body via the first open end. The end caps further comprise a second pair of caps which permits the water to enter and exit the hollow storage body via only the second open end.

DESCRIPTION OF EXAMPLE EMBOIDMENTS

Figure 1:
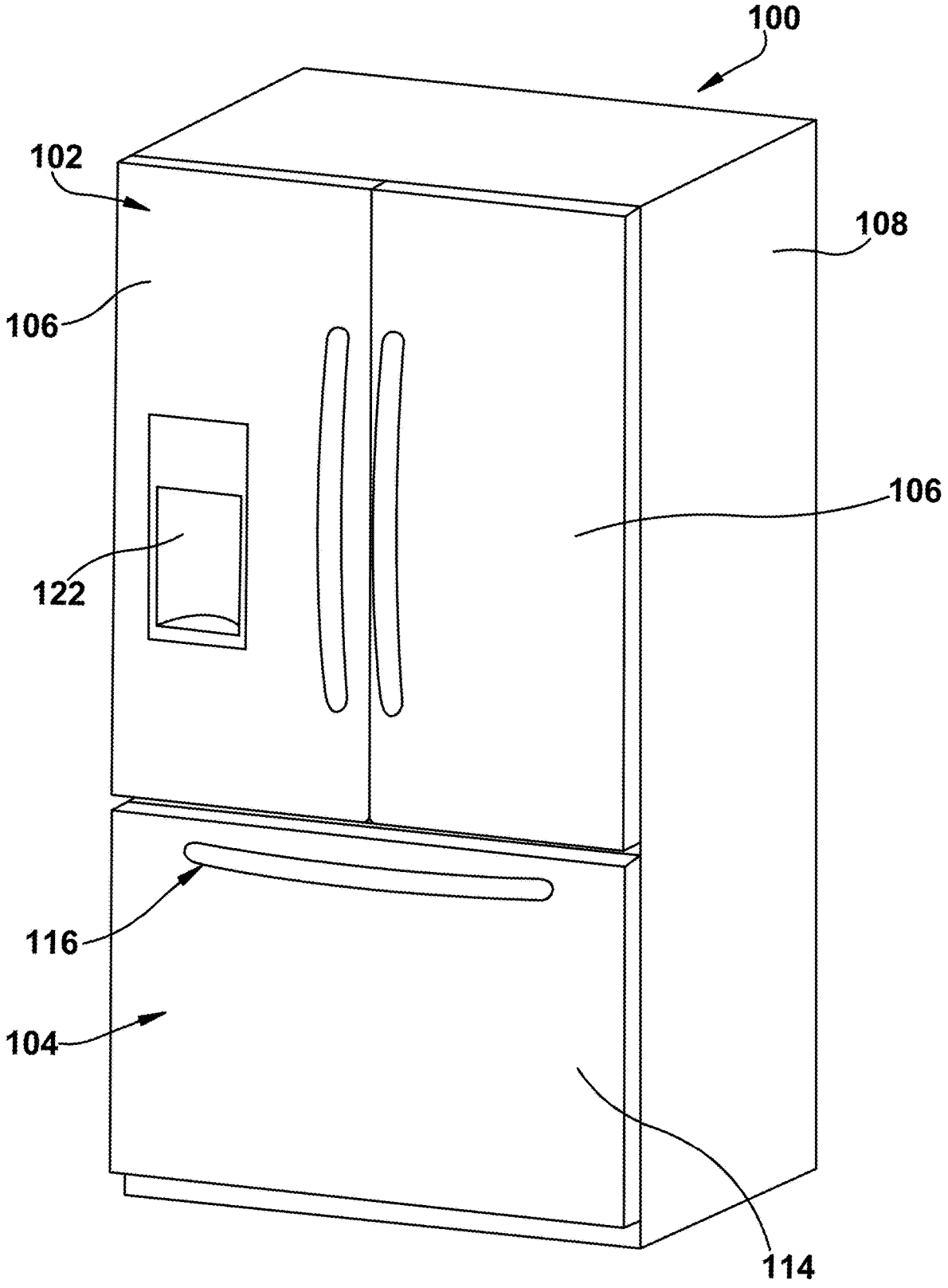
FIG. 1 is a front schematic view of a refrigerator.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. Further, an embodiment is described in detail below, and shown in the figures as a bottom-mount configuration of a refrigerator 100, including a fresh food compartment 102 disposed vertically above a freezer compartment 104. It is to be understood that other configurations are contemplated, for example, a top-mount refrigerator (i.e., fresh food compartment disposed vertically below the freezer compartment), a side by side refrigerator (i.e., fresh food compartment disposed laterally adjacent the freezer compartment), a single compartment refrigerator (i.e., having only a fresh food compartment or a freezer compartment), refrigerators including variable climate zone compartments, etc.

One or more doors 106 are pivotally coupled to a cabinet 108 of the refrigerator 100 to restrict and grant access to the fresh food compartment 102. The door(s) 106 can include a single door that spans the entire lateral distance across the entrance to the fresh food compartment 102, or can include a pair of French-type doors 106, as shown in FIG. 1, that collectively span the entire lateral distance of the entrance to the fresh food compartment 102 to enclose the fresh food compartment 102.

Figure 2:
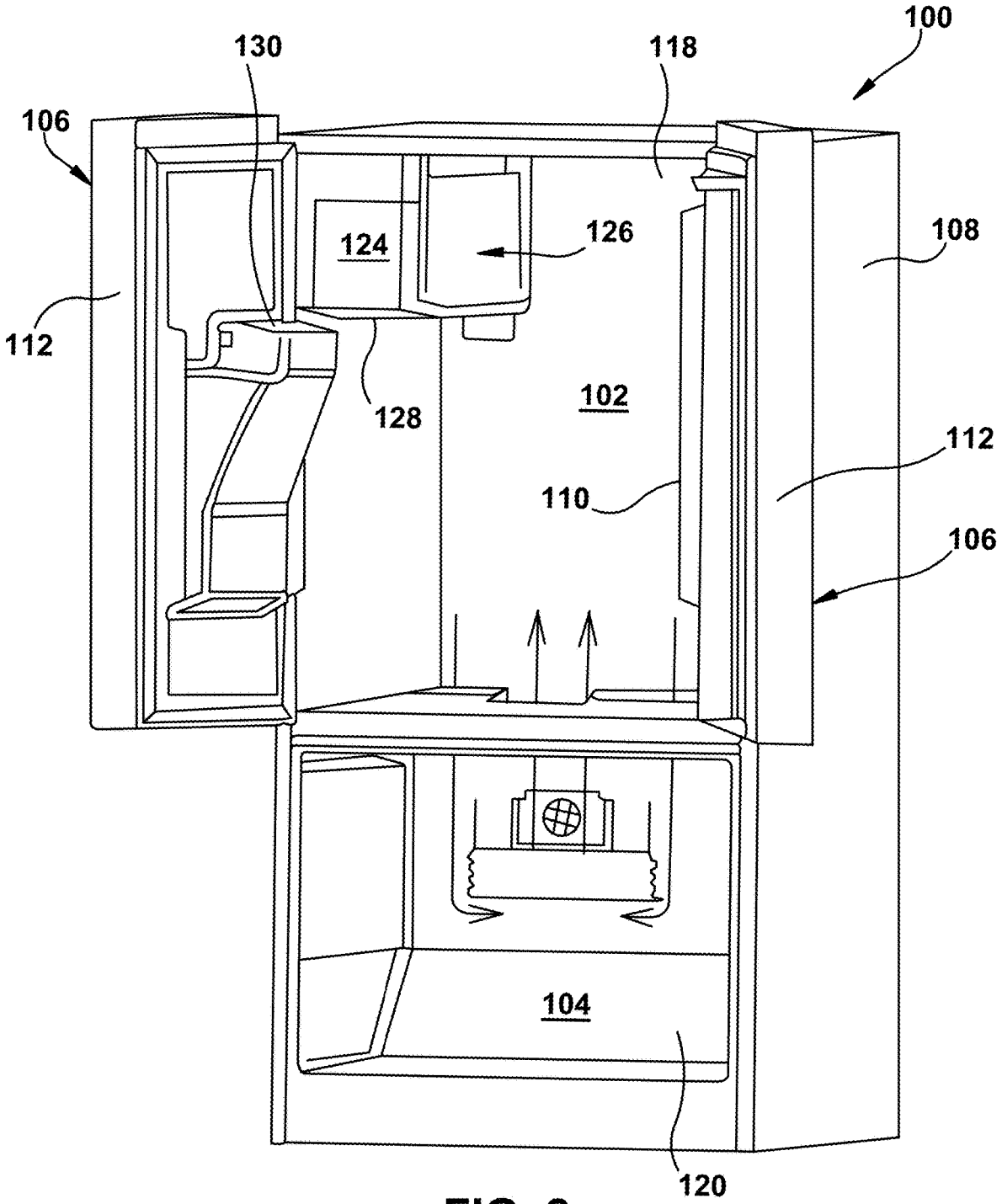
FIG. 2 is a perspective schematic view of the refrigerator in FIG. 1.

As shown in FIG. 2, a center flip mullion 110 is pivotally coupled to at least one of the doors 106 to establish a surface against which a seal provided to the other one of the doors 106 can seal the entrance to the fresh food compartment 102 at a location between opposing side surfaces 112 of the doors 106. The center flip mullion 110 can be pivotally coupled to the door 106 to pivot between a first orientation that is substantially parallel to a planar surface of the door 106 when the door 106 is closed, and a different orientation when the door 106 is opened. The externally-exposed surface of the center flip mullion 110 is substantially parallel to the door 106 when the center flip mullion 110 is in the first orientation, and forms an angle other than parallel relative to the door 106 when the center flip mullion 110 is in the second orientation. The seal and the externally-exposed surface of the center flip mullion 110 cooperate approximately midway between the lateral sides of the fresh food compartment 102.

Moving back to FIG. 1, the freezer compartment 104 is arranged vertically beneath the fresh food compartment 102. A drawer assembly (not shown) including one or more freezer baskets (not shown) can be withdrawn from the freezer compartment 104 to grant a user access to food items stored in the freezer compartment 104. The drawer assembly can be coupled to a freezer door 114 that includes a handle 116. When a user grasps the handle 116 and pulls the freezer door 114 open, at least one or more of the freezer baskets is caused to be at least partially withdrawn from the freezer compartment 104.

The freezer compartment 104 is used to freeze and/or maintain articles of food stored therein in a frozen condition. For this purpose, the freezer compartment 104 is in thermal communication with a freezer evaporator (not shown) that removes thermal energy from the freezer compartment 104 to maintain the temperature therein at a temperature of 0° C. or less during operation of the refrigerator 100, preferably between 0° C. and −50° C., more preferably between 0° C. and −30° C. and even more preferably between 0° C. and −20° C.

Moving back to FIG. 2, the refrigerator 100 further includes an interior liner comprising a fresh food liner 118 and a freezer liner 120 which define the fresh food and freezer compartments 102, 104, respectively. The fresh food compartment 102 is located in the upper portion of the refrigerator 100 in this example and serves to minimize spoiling of articles of food stored therein. The fresh food compartment 102 accomplishes this by maintaining the temperature in the fresh food compartment 102 at a cool temperature that is typically above 0° C., so as not to freeze the articles of food in the fresh food compartment 102. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 102 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 102 independent of the freezer compartment 104. According to an embodiment, the temperature in the fresh food compartment 102 can be maintained at a cool temperature within a close tolerance of a range between 0° C. and 4.5° C., including any subranges and any individual temperatures falling with that range. For example, other embodiments can optionally maintain the cool temperature within the fresh food compartment 102 within a reasonably close tolerance of a temperature between 0.25° C. and 4° C.

With respect to FIG. 1, a water dispenser 122 is disposed at one of the doors 106 and is provided to dispense liquid (e.g., water) and/or ice pieces therefrom. As shown, the water dispenser 122 is provided on an exterior of one of the doors 106 such that a user can acquire water and/or ice pieces without opening said door 106. Alternatively, it is contemplated that the water dispenser 122 can be positioned on an interior of one of the doors 106 such that a user must first open said door 106 before interacting with the water dispenser 122.

In operation, when a user desires ice (e.g., ice pieces), the user interacts with an actuator (e.g., lever, switch, proximity sensor, etc.) to cause frozen ice pieces to be dispensed from an ice bin 124 (FIG. 2) of an ice maker 126 disposed within the fresh food compartment 102. Ice pieces stored within the ice bin 124 can exit the ice bin 124 through an aperture 128 and be delivered to the water dispenser 122 via an ice chute 130, which extends at least partially through the door 106 between the water dispenser 122 and the ice bin 124.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

Additionally, when a user desires water, the user interacts with the actuator to acquire water from the water dispenser 122. Generally, water is directed through a water circuit of the refrigerator 100 wherein it is pumped to the water dispenser 122 from an external source (not shown). Typically, such water circuits include a series of water lines (e.g., conduits, tubes, etc.) to transport the water from the external source to the water dispenser 122. Filters and water storage tanks are often also employed to filter the water passing therethrough and to store said water (either filtered or unfiltered) for subsequent downstream use.

Figure 3:
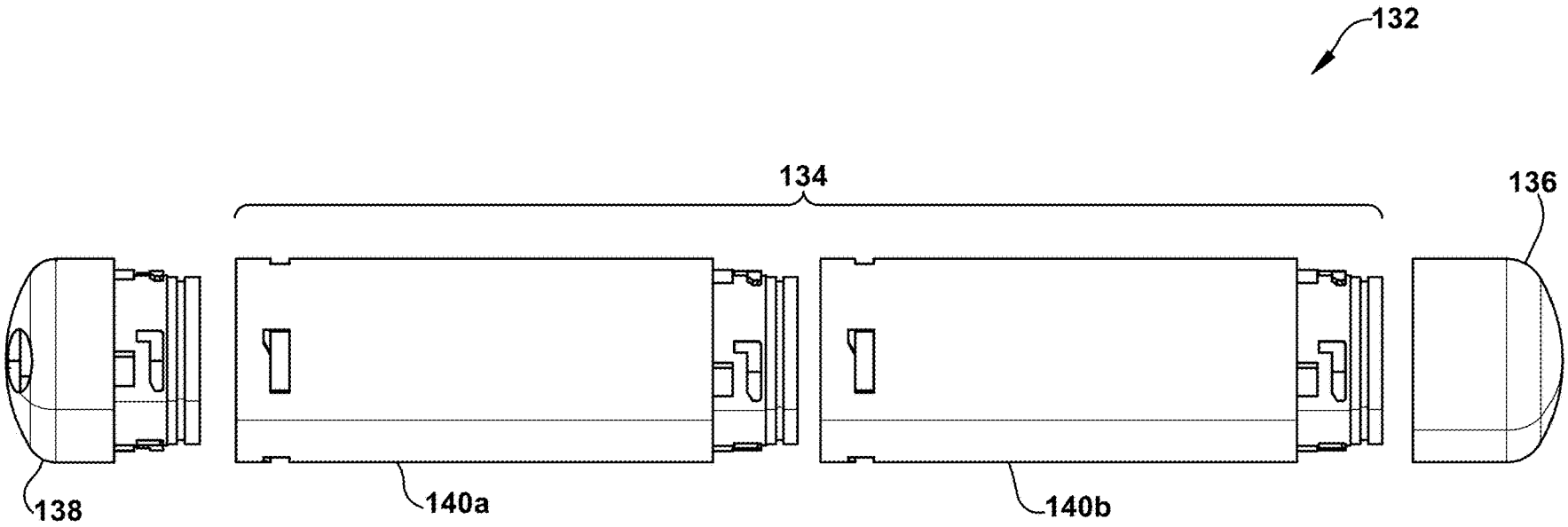
FIG. 3 is an exploded view of an example modular water storage tank.
Figure 7:
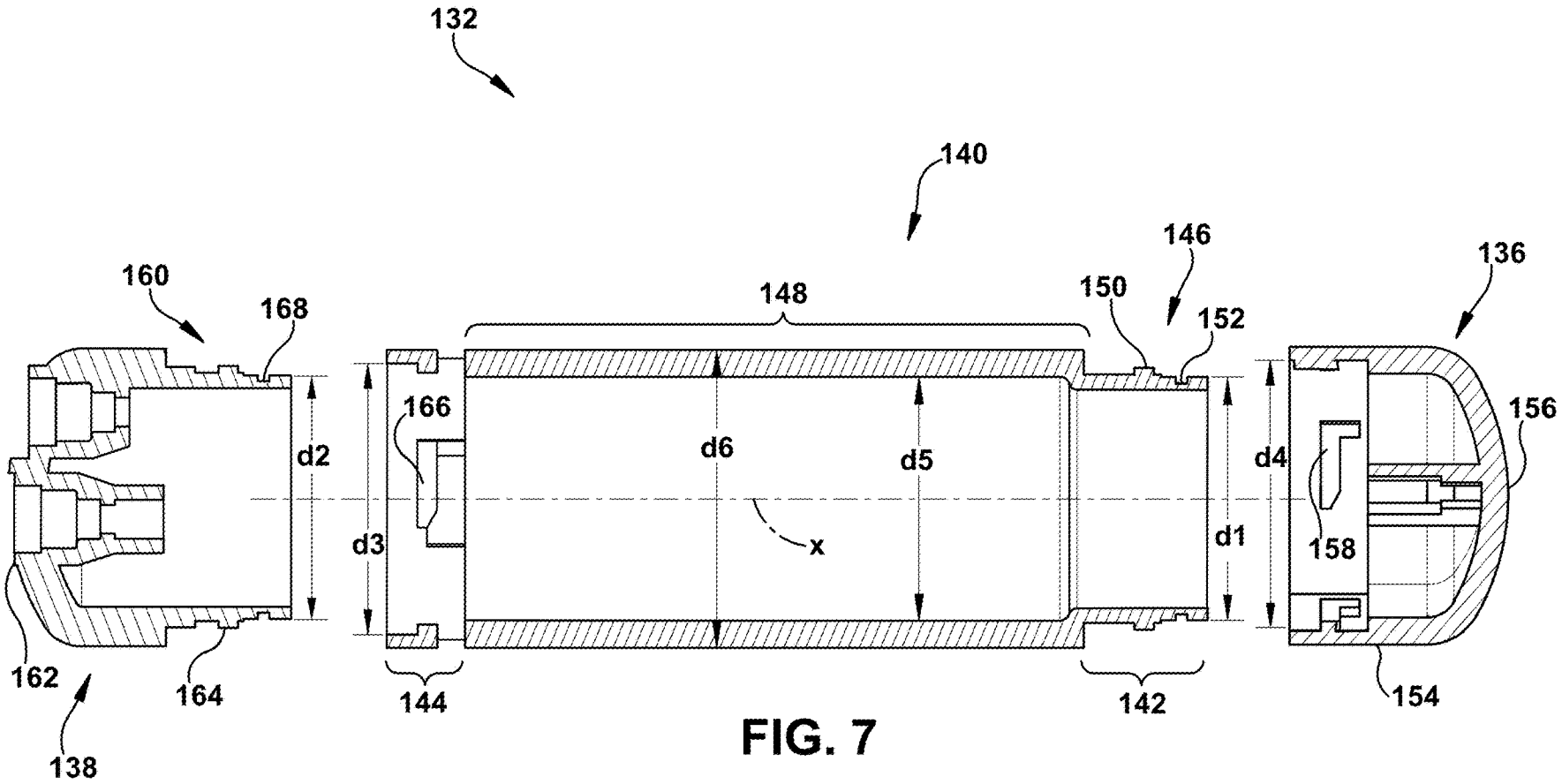
FIG. 7 is a side cross-sectional view of another embodiment of the modular water storage tank.

Moving on to FIG. 3, a modular water storage tank 132 for the refrigerator 100 is shown in an exploded view. The modular water storage tank 132 includes a hollow storage body 134, a female end cap 136, and a male end cap 138. In particular, the hollow storage body 134 comprises at least one body member 140. Specifically, in the shown embodiment, the hollow storage body 134 includes a first body member 140*a* and a second body member 140*b*. The first and second body members 140*a*, 140*b* are identical to one another and are configured to be linearly connected to one another in order to form the hollow storage body 134. It is to be understood that other configurations are contemplated. For example, any number of body members can be used, including only a single body member (as shown in FIG. 7, discussed below). It is to be further understood that the first and second body members 140*a*, 140*b* are non-removably connected to one another in order to ensure a proper/secure seal therebetween.

In this manner, by being able to use a varying amount of body members 140, an overall storage capacity of the modular water storage tank 132 is quickly and efficiently changeable. For example, if two body members 140 are used, this doubles the volume of the modular water storage tank 132, and if three body members 140 are employed, this triples the volume of the modular water storage tank 132, and so on. That is, the modular water storage tank 132 can be installed in a variety of different refrigerator models, each refrigerator model having its own specifications with respect to location/placement of the water storage tank and desired water storage requirements.

Figure 4:
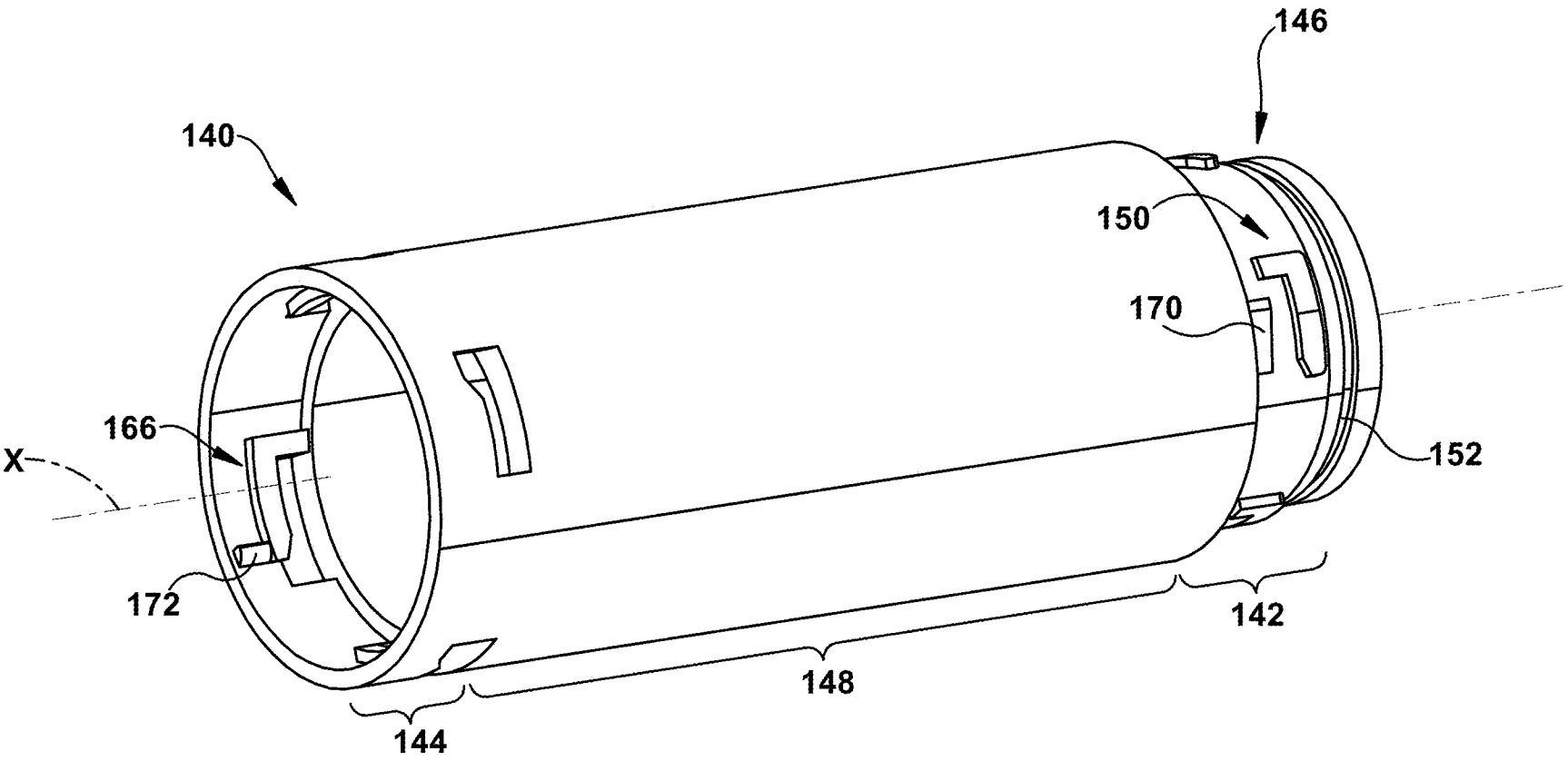
FIG. 4 is a perspective view of a body member of the modular water storage tank shown in FIG. 3.

With respect to FIG. 4, a single body member 140 is depicted as being in a shape of a cylinder having a hollow interior to store water therein. Specifically, the cylinder is shown as having a circular cross-sectional geometry. It is further contemplated that the body member(s) 140 may have other cross-sectional geometries (e.g., ellipse, square, rectangle, triangle, etc.). The body member 140 comprises first and second open ends 142, 144 that are axially spaced from one another along a longitudinal axis X of the body member 140. More specifically, the first and second open ends 142, 144 face opposite directions with respect to one another. The first open end 142 comprises a first male extension 146 that extends outwards and away from a central portion 148 of the body member 140. Specifically, the central portion 148 of the body member 140 extends between the first and second open ends 142, 144, and preferably has a uniform cross-section. Alternatively, the central portion 148 can have a varying cross-section.

The first male extension 146 includes a first connection member 150 disposed on an outer circumferential surface thereof. Further, a first groove 152 is formed in the outer circumferential surface of the first male extension 146 and is configured to accept a sealing member (not shown) therein. Said sealing member may be a typical rubber gasket (e.g., an O-ring) or any other member configured to fluidly seal separate structures. The first groove 152 circumferentially surrounds the first male extension 146. Alternatively, it is contemplated that the first groove 152 can only be formed at specific circumferential locations of the first male extension 146.

Figure 5:
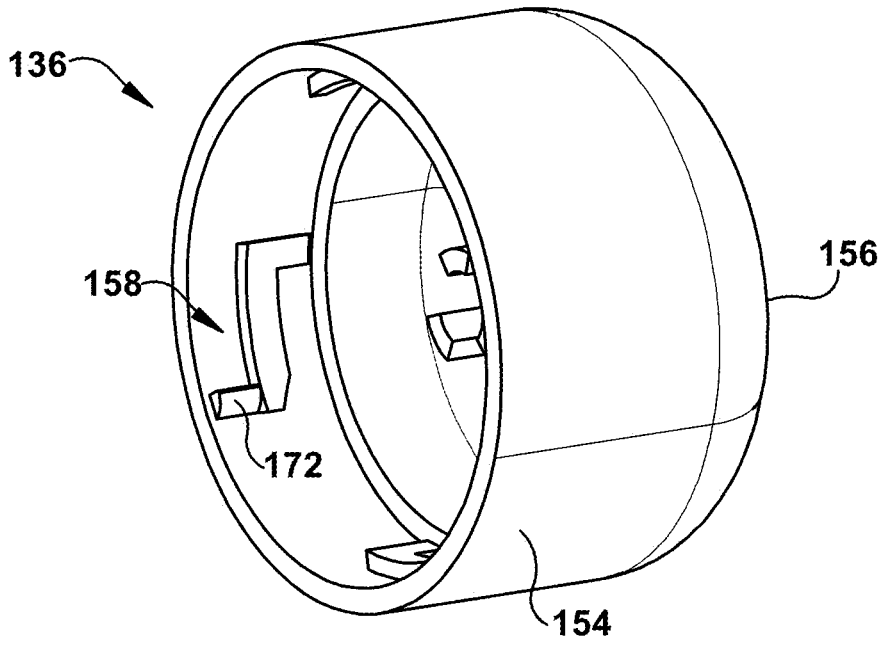
FIG. 5 is a perspective view of a female end cap of the modular water storage tank shown in FIG. 3.

Moving on to FIG. 5, the female end cap 136 is shown as comprising a side wall 154 that extends outwards and away from a front end wall 156. An inner circumferential surface of the side wall 154 includes a second connection member 158 disposed thereon. As will be discussed further below, this second connection member 158 is shaped and configured to engage with the first connection member 150.

Figure 6:
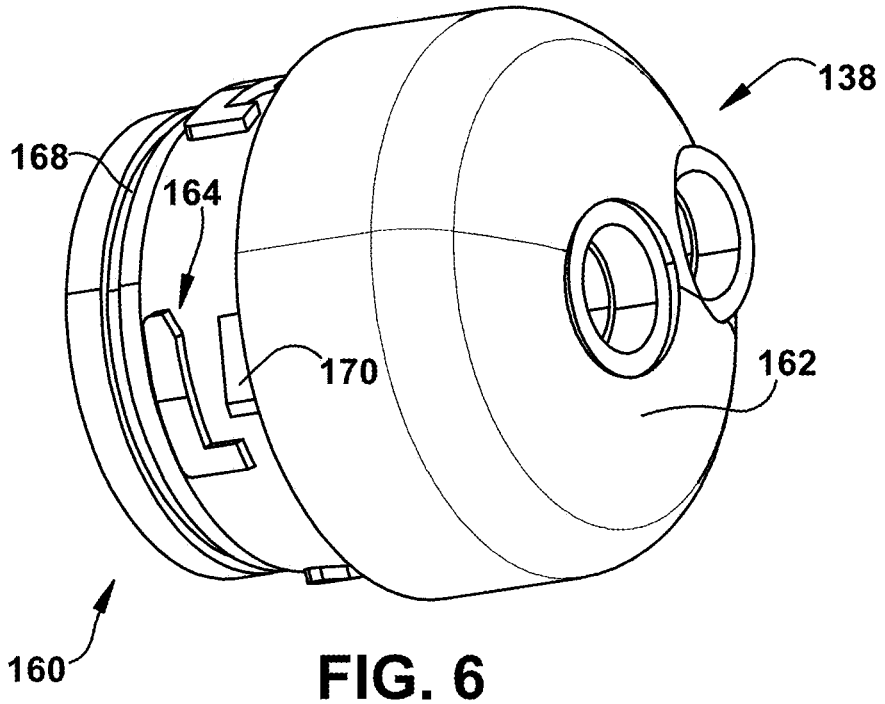
FIG. 6 is a perspective view of a male end cap of the modular water storage tank shown in FIG. 3.

With respect to FIG. 6, the male end cap 138 is shown as having a second male extension 160 extending outwards and away from a rear end wall 162. The second male extension 160 is cylindrical in shape and includes a third connection member 164 disposed on an outer circumferential surface thereof. Specifically, as will be further discussed below, this third connection member 164 is shaped and configured to engage with a fourth connection member 166 (shown in FIG. 4) located on an inner circumferential surface at the second open end 144 of the body member 140. Further, a second groove 168 is formed in the outer circumferential surface of the second male extension 160 and is configured to accept a sealing member (not shown) therein.

Moving on to FIG. 7, the modular water storage tank 132 is shown in a sectional exploded view. Specifically, the female end cap 136 is configured to be secured to the first open end 142 of the body member 140. More specifically, the female end cap 136 is to be non-removably secured to the first open end 142 of the body member 140. This ensures a proper seal is made therebetween such that water leakage does not occur. This connection is accomplished by engaging the first connection member 150 located on the first male extension 146 with the second connection member 158 positioned on the inner circumferential surface of the side wall 154 of the female end cap 136. When the female end cap 136 is secured to the first open end 142 of the body member 140, the side wall 154 of the female end cap 136 at least partially surrounds the first male extension 146.

In a similar manner, the male end cap 138 is configured to be non-removably secured to the second open end 144 of the body member 140. This is achieved by engaging the third connection member 164 located on the second male extension 160 with the fourth connection member 166 positioned at the inner circumferential surface of the second open end 144. When the male end cap 138 is secured to the second open end 144 of the body member 140, said inner circumferential surface at the second open end 144 at least partially surrounds the second male extension 160.

As further shown, the outer circumferential surface of the first male extension 146 has a diameter d1 and the outer circumferential surface of the second male extension 160 has a diameter d2. The diameters d1, d2 of the outer circumferential surfaces of the first and second male extensions 146, 160, respectively, are equal to one another. In this manner, the first male extension 146 is configured such that it is sized and shaped to non-removably connect with either the female end cap 136 or, as depicted in FIG. 3, a second open end of another body member. To further promote correct engagement of the first male extension 146 with the second open end of another body member, the first male extension 146 and the second male extension 160 are identical. That is, both the first and second male extensions 146, 160 include a groove formed therein and identical connection members formed on respective outer circumferential surfaces thereof.

As further depicted in FIG. 7, the inner circumferential surface at the second open end 144 of the body member 140 has a diameter d3, and the inner circumferential surface of the side wall 154 of the female end cap 136 has a diameter d4. The diameters d3, d4 of the inner circumferential surfaces of the second open end 144 and the side wall 154, respectively, are equal to one another.

Further still, an inner circumferential surface of the central portion 148 of the body member 140 has a diameter d5, and an outer circumferential surface of the central portion 148 of the body member 140 has a diameter d6. As shown, the diameter d1 of the outer surface of the first male extension 146 is smaller than the diameter d6 of the outer circumferential surface of the central portion 148 of the body member 140. Additionally, the diameter d4 of the inner circumferential surface of the side wall 154 of the female end cap 136 is greater than the diameter d1 of the outer circumferential surface of the first male extension 146.

Moreover, the diameter d2 of the outer circumferential surface of the second male extension 160 is smaller than the diameter d3 of the inner circumferential surface at the second open end 144 of the body member 140. Due to this configuration, when the female and male end caps 136, 138 are coupled to the first and second open ends 142, 144 of the body member 140, respectively, the outermost surfaces of the female and male end caps 136, 138 will be flush with the outer most surface of the central portion 148 of the body member 140.

Briefly moving back to FIGS. 4-6, it is shown that the first, second, third, and fourth connection members 150, 158, 164, 166 all comprise bayonet connectors. Preferably, each of the first, second, third, and fourth connection members 150, 158, 164, 166 includes a total of four bayonet connectors that are equally spaced from one another and circumferentially distributed about the longitudinal axis X of the body member 140. Alternatively, each of the first, second, third, and fourth connection members 150, 158, 164, 166 may have varying amounts of bayonet connectors (e.g., only 2 bayonet connectors, etc.). It is further shown that the first connection member 150 and the third connection member 164 each further comprises a latch 170. That is, each bayonet connector of the first and third connection members 150, 164 may include its own latch 170, such that the first and third connection members 150, 164 each has a total of four latches 170 associated with each of their fourth bayonet connectors.

Moreover, each of the second connection member 158 and the fourth connection member 166 further includes a stop 172 configured to engage the respective latches 170 of the first and third connection members 150, 164 when the first, second, third, and fourth connection members 150, 158, 164, 166 are fully engaged to prevent accidental removal of the female and male end caps 136, 138 to the first and second open ends 142, 144, respectively, of the body member 140. Preferably, each of the second and fourth connection members 158, 166 includes only a single stop 172. This permits the female and male end caps 136, 138 to be secured to the first and second open ends 142, 144, respectively, without requiring a specific alignment. For example, the male end cap 136 may be inserted into the second open end 144 without needing to align the latch(es) 170 of the male end cap 136 in a specific orientation with respect to the stop 172 of the second open end 144. However, it is to be understood that each of the second and fourth connection members 158, 166 may include a plurality of stops 172 such that, each stop 172 engages a respective latch 170 in a connection position.

To further promote correct engagement between the first male extension 146 of the body member 140 and either the female end cap 136 or a second open end of another body member, as shown in FIG. 3, the first and third connection members 150, 164 are identical, and the second and fourth connection members 158, 166 are identical.

When the female and male end caps 136, 138 are secured to the first and second open ends 142, 144 of the hollow storage body 134 (i.e., comprising at least one body member 140), an interior storage space is defined within the hollow storage body 134 for storing water therein. Additionally, the sealing member provided in the first groove 152 sealingly engages the outer circumferential surface of the first male extension 146 and the inner circumferential surface of the side wall 154 of the female end cap 136. Further, the sealing member provided in the second groove 168 sealingly engages the outer circumferential surface of the second male extension 160 of the male end cap 138 and the inner circumferential surface at the second open end 144 of the body member 140.

As discussed above, the modular water storage tank 132 is modifiable to increase the total water storage capabilities thereof. As will be detailed below, the modular water storage tank 132 is further provided with different pairs of female and male end caps 136, 138 in order to modify a direction in which the water flows into and out of said modular water storage tank 132.

Figure 8A:
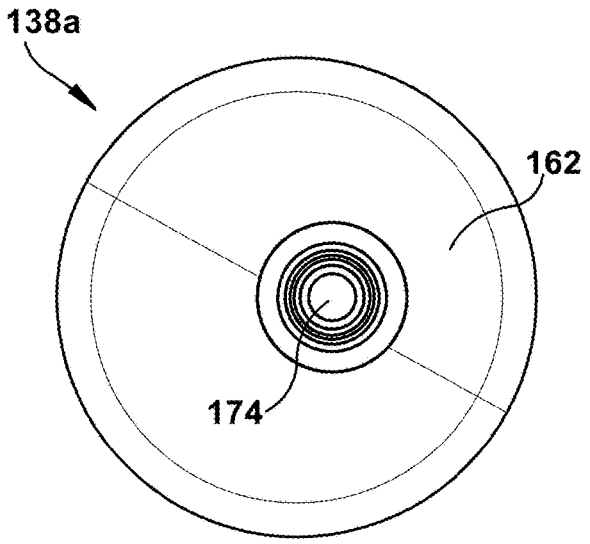
FIG. 8A is a rear view of a male end cap of a first pair of end caps.

Specifically, the modular water storage tank 132 includes first and second pairs of end caps, wherein each pair of end caps comprises one female end cap 136 and one male end cap 138. With respect to FIGS. 8A and 8B, a male end cap **138*a* and a female end cap 136*a* of the first pair of end caps are shown. The male end cap 138*a* of the first pair of end caps has an inlet 174 to permit water to enter the interior storage space of the hollow storage body 134 via the second open end 144 thereof. As shown, the inlet 174 is formed in the rear end wall 162 of the male end cap 138*a*. Alternatively, the inlet 174 can be formed in a different surface of the male end cap 138*a***, for example, a side wall thereof.

Figure 8B:
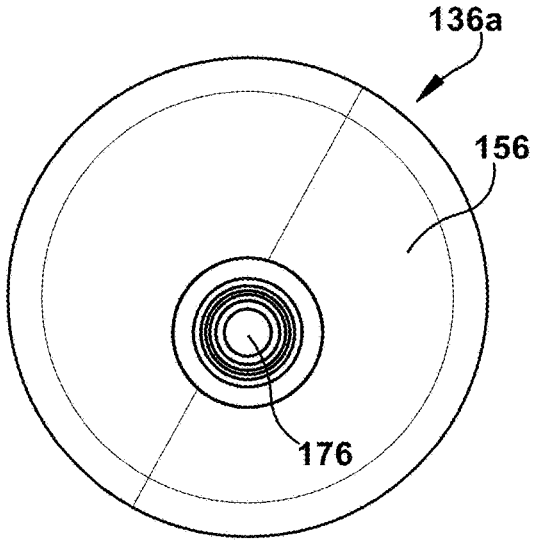
FIG. 8B is a rear view of a female end cap of the first pair of end caps.

As shown in FIG. 8B, the female end cap **136*a* of the first pair of end caps has an outlet 176 to permit the water to exit the interior storage space of the hollow storage body 134 via the first open end 142 thereof. Specifically, the outlet 176 is shown as being formed in the front end wall 156 of the female end cap 136*a*. Alternatively, the outlet 176 can be formed in a different surface of the female end cap 136*a*, for example, the side wall 154 of the female end cap 136*a***.

It is further contemplated that the orientation of the hollow storage body 134 and/or the female and male end caps **136*a*, 138*a* can be reversed. That is, the female end cap 136*a* of the first pair of end caps may include the inlet and the male end cap 138*a* of the first pair of end caps may include the outlet such that water flows into the interior storage space of the hollow storage body 134 from the first open end 142 thereof, and exits said interior storage space via the second open end 144** thereof.

Figure 9:
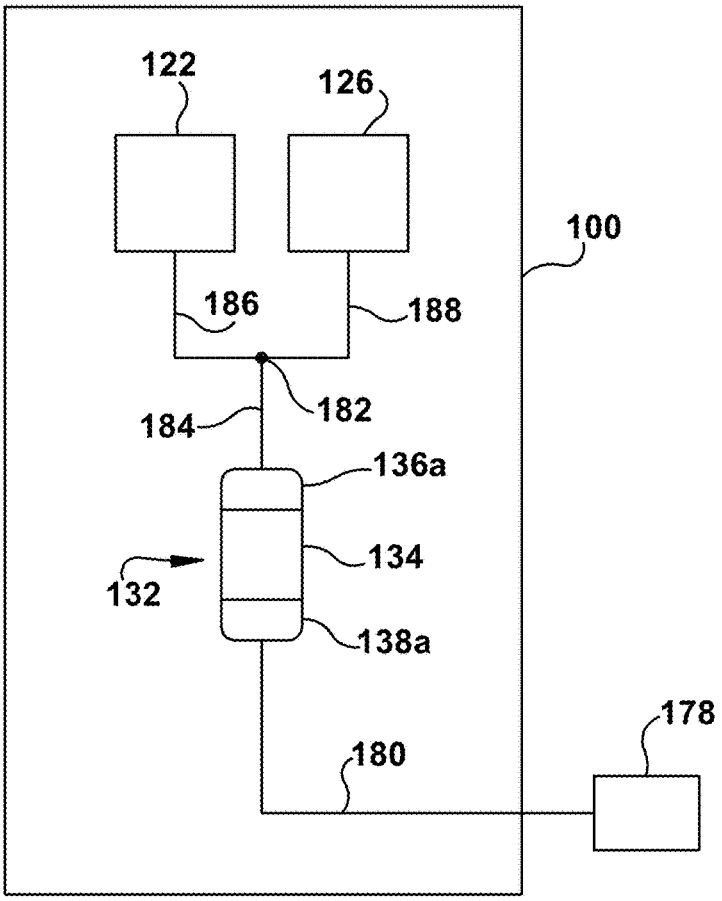
FIG. 9 is a schematic view of a water circuit in a refrigerator including a modular water storage tank having the first pair of end caps.

With reference to FIG. 9, a schematic layout of the water circuit within the refrigerator 100 is shown. Specifically, the water circuit includes the modular water storage tank 132 having the female and male end caps **136*a*, 138*a* of the first pair of end caps. The modular water storage tank 132 is housed within the refrigerator 100 and is disposed (i.e., in fluid communication) between an upstream water source 178 (e.g., an external water source) and a downstream destination. Further, when the modular water storage tank 132 is fully assembled and installed within the refrigerator 100, it makes a leak-proof enclosure for the water. In the shown example, the downstream destination is either the water dispenser 122 and/or the ice maker 126. However, it is to be understood that the downstream destination may be a different element of and/or associated with the refrigerator 100**.

During operation, water exits the upstream water source 178 and is directed to the modular water storage tank 132 via a first water line 180. Specifically, the water enters the interior storage space of the hollow storage body 134 via the inlet 174 in the male end cap 138*a* of the first pair of end caps. Water then exits the interior storage space of the hollow storage body 134 via the outlet 176 in the female end cap 136*a* of the first pair of end caps. Said water is then directed to a junction (e.g., a valve 182) via a second water line 184. Depending on an operation of the valve 182, the water is directed to either the water dispenser 122 or the ice maker 126 via third or fourth water lines 186, 188, respectively. For example, the valve 182 can be a double solenoid valve, two separate solenoid valves, or any other type of valve known in the art of household appliances.

Figure 10A:
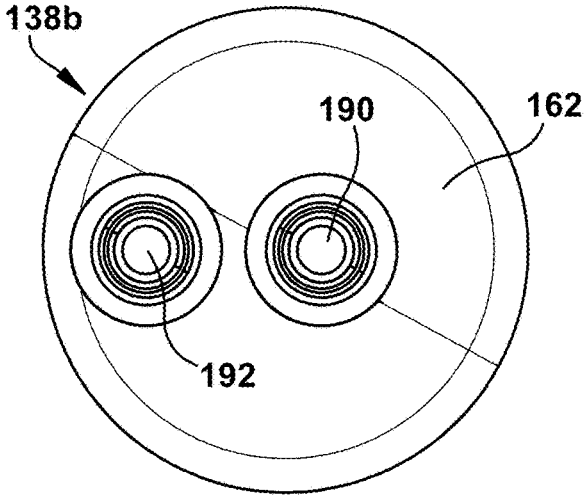
FIG. 10A is a rear view of a male end cap of a second pair of end caps.
Figure 10B:
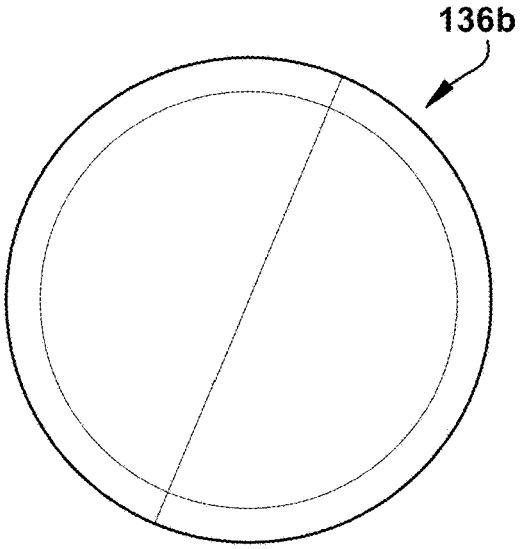
FIG. 10B is a rear view of a female end cap of the second pair of end caps.

Moving on to FIGS. 10A-10B, a male end cap 138*b* and a female end cap 136*b* of the second pair of end caps are shown. The male end cap 138*b* of the second pair of end caps has an inlet 190 to permit water to enter the interior storage space of the hollow storage body 134 via the second open end 144 thereof. The male end cap 138*b* of the second pair of end caps further includes an outlet 192 to permit the water to also exit the interior storage space of the hollow storage body 134 via the second open end 144 thereof. The inlet 190 and the outlet 192 are both shown as being formed in the rear end wall 162 of the male end cap 138*b*. Alternatively, the inlet 190 and/or the outlet 192 can be formed in a different surface of the male end cap 138*b*, for example, a side wall thereof.

The male end cap 138*b* of the second pair of end caps is provided to permit the water to enter and exit the interior storage space via only the second open end 144 of the hollow storage body 134. That is, as shown in FIG. 10B, the female end cap 136*b* includes no inlets/outlets that would permit the water to enter and/or exit the interior storage space of the hollow storage body 134 via the first open end 142 thereof.

It is further contemplated that the orientation of the hollow storage body 134 and/or the female and male end caps 136*b*, 138*b* can be reversed. That is, the female end cap 136*b* of the second pair of end caps may include both the inlet 190 and the outlet 192 while the male end cap 138*b* of the second pair of end caps includes no inlets/outlets that would permit the water to enter and/or exit the interior storage space of the hollow storage body 134 via the second open end 144 thereof.

Figure 11:
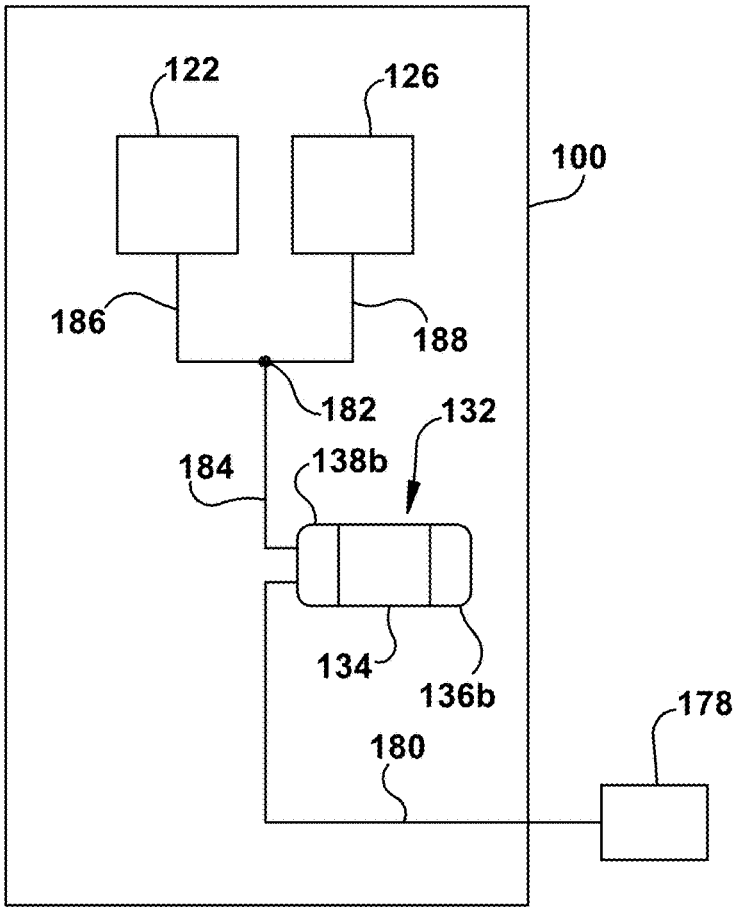
FIG. 11 is a schematic view of a water circuit in a refrigerator including a modular water storage tank having the second pair of end caps.

With reference to FIG. 11, the water routing system of the refrigerator 100 is shown as including the modular water storage tank 132 having the female and male end caps 136*b*, 138*b* of the second pair of end caps. During operation, water exits the upstream water source 178 and is directed to the modular water storage tank 132 via the first water line 180. The water enters the interior storage space of the hollow storage body 134 via the inlet 190 in the male end cap 138*b* of the second pair of end caps. Water housed in the modular water storage tank 132 then exits the interior storage space via the outlet 192 in the male end cap 138*b* of the second pair of end caps. In other words, the male end cap 138*b* of the second pair of end caps permits the water to enter and exit the interior storage space via only the second open end 144 of the hollow storage body 134.

Figure 12:
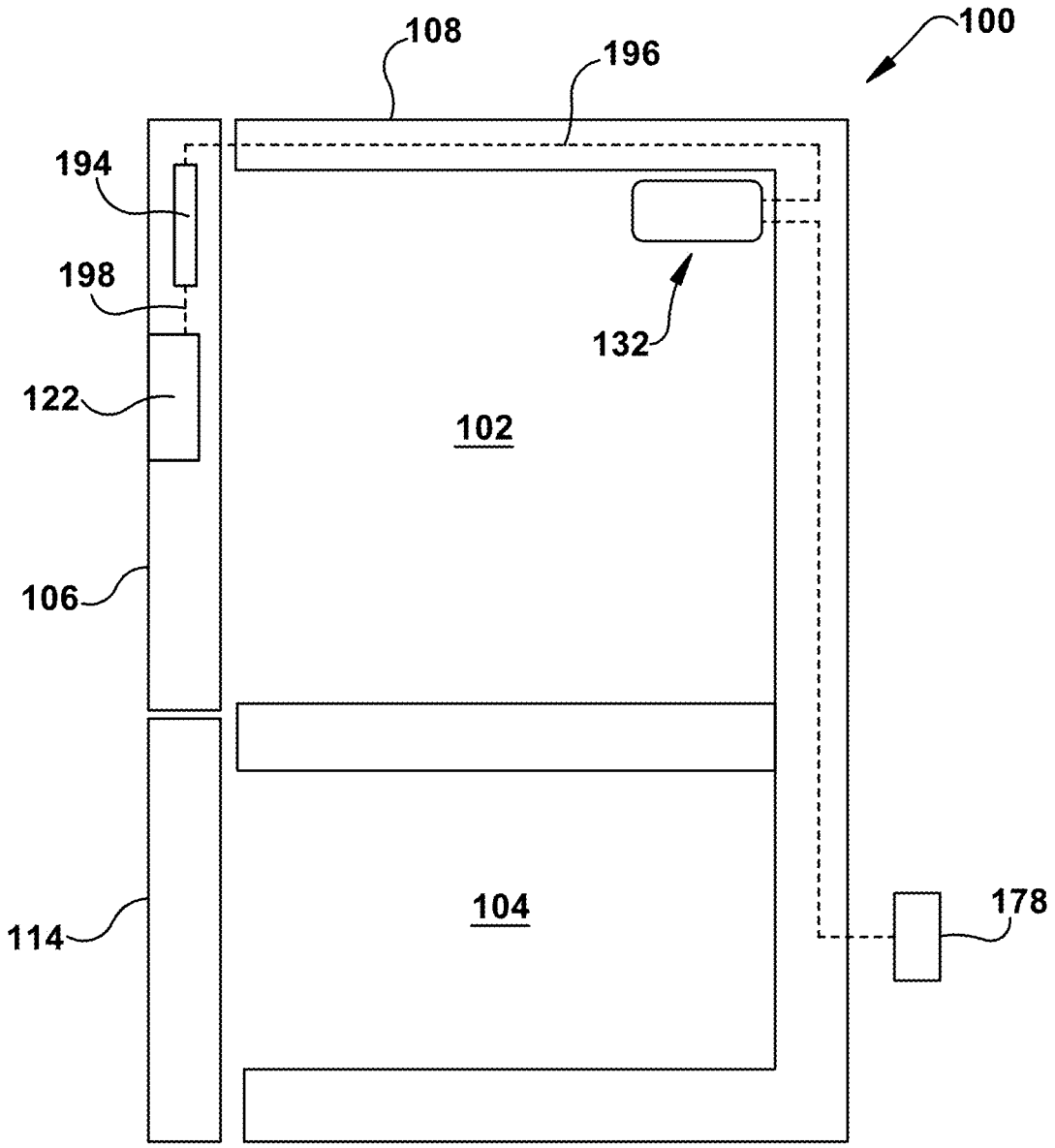
FIG. 12 is schematic cross-sectional view of a refrigerator having a primary water storage tank in a storage chamber, and a secondary water storage tank in a door of said refrigerator.

In a further example, as shown in FIG. 12, the refrigerator includes multiple water storage tanks. Specifically, the refrigerator 100 includes a primary water storage tank located within the cabinet 108 and a secondary water storage tank 194 located outside said cabinet 108. As shown, the primary water storage tank comprises the aforementioned modular water storage tank 132, whereas the secondary water storage tank 194 can be either an additional modular water storage tank, as previously disclosed, or a normal water storage tank commonly known and used in the field of household appliances. For example, the primary water storage tank can be a modular water storage tank 132 having a larger volume (i.e., comprising two or more body members 140) than the secondary water storage tank 194, being a modular water storage tank comprising only a single body member 140. The secondary water storage tank 194 is disposed fluidly between the modular water storage tank 132 and the downstream destination. Specifically, the secondary water storage tank 194 is fluidly located between the modular water storage tank 132 and the water dispenser 122. Alternatively, one of the primary or secondary water storage tank may not be modular.

The addition of the secondary water storage tank 194 ensures that an initial portion of water being dispensed via the water dispenser 122 is cold. That is, in refrigerators employing only a single water storage tank throughout the entire water circuit, the total length of the water line between said water storage tank and the dispenser is generally long. As such, the initial portion of water being dispensed tends to be warmer than desired. To eliminate such phenomena, the secondary water storage tank 194 stores and insulates this initial portion of water such that, when a user actuates the dispenser, cold water is continuously dispensed.

With respect to FIG. 12, the secondary water storage tank 194 is disposed at the door 106 of the fresh food compartment 102. That is, the secondary water storage tank 194 can be disposed on or within said door 106. In operation, a first water line 196 fluidly connects the modular water storage tank 132 and the secondary water storage tank 194. A second water line 198 further connects the secondary water storage tank 194 and the water dispenser 122. When a user actuates the water dispenser 122, water stored within the secondary water storage tank 194 is directed to the water dispenser 122 via the second water line 198. Simultaneously, water stored within the modular water storage tank 132 is directed to the secondary water storage tank 194 and to the water dispenser 122. In this manner, the user receives a continuous stream of cold, dispensed water.

Figure 13:
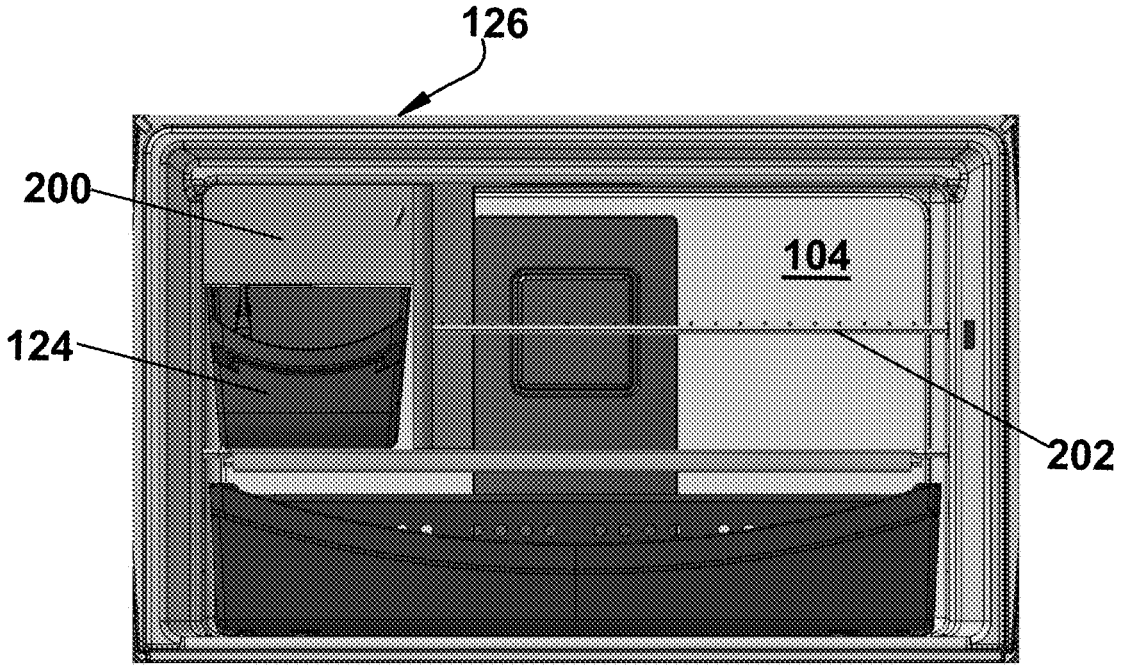
FIG. 13 is a partial front view of a top-mount refrigerator.

In a separate embodiment, as shown in FIG. 13, a top mount refrigerator 100 (i.e., a freezer compartment 104 disposed vertically above a fresh food compartment 102) is partially shown wherein the ice maker 126 is disposed within the freezer compartment 104. The ice maker 126 includes a housing cover 200 disposed above and alongside the ice bin 124. The housing cover 200 covers the functional components of the ice maker 126 and may have mounting locations for various elements such as an on/off switch, wire harness, electronic boards, supports for a freezer shelf 202, etc.

Figure 14:
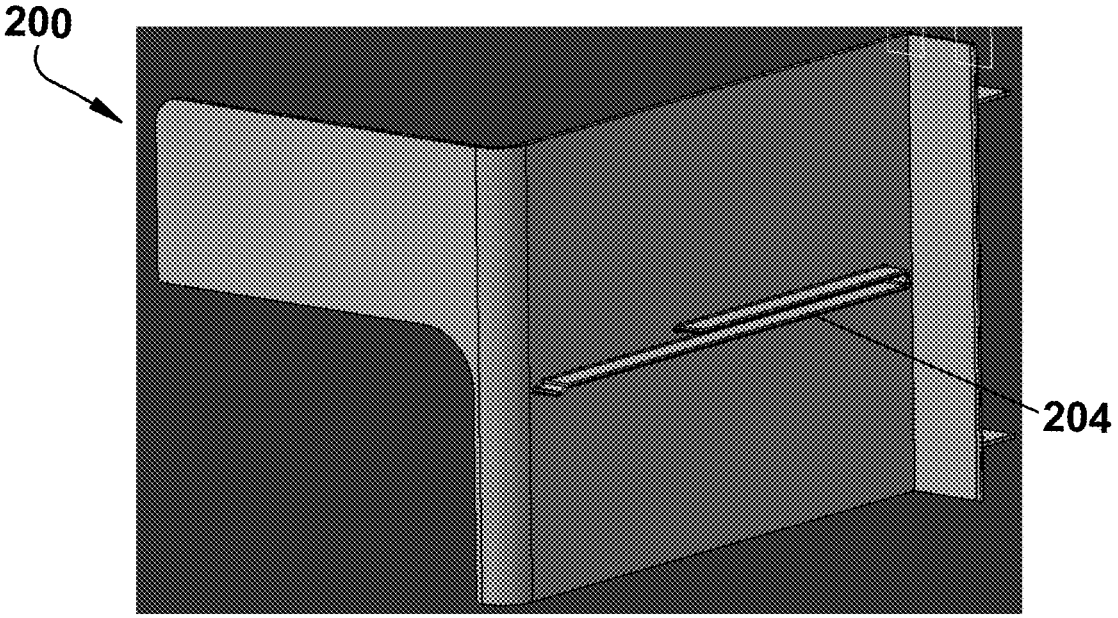
FIG. 14 is a front perspective view of a housing cover of an ice maker shown in FIG. 13.

Specifically, as shown in FIG. 14, an external side wall of the housing cover 200 has supports 204 formed therein that are configured to support a side of the freezer shelf 202. The supports 204 may be formed integral with the housing cover 200 such that the supports 204 and the housing cover 200 are formed during a single injection molding process. Alternatively, the supports 204 may be separate and distinct elements with respect to the housing cover 200 that are subsequently attached thereto after the housing cover 200 is molded.

Figure 15:
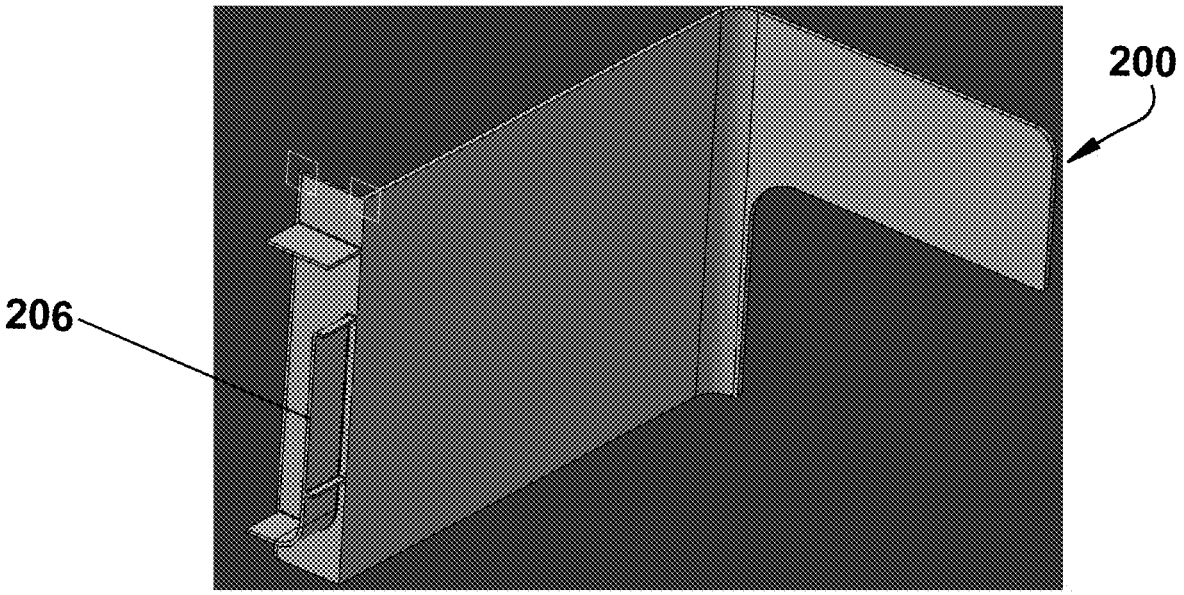
FIG. 15 is a rear perspective view of the housing cover shown in FIG. 14.

As further shown in FIG. 15, a rear surface of a rear wall of the housing cover 200 includes a duct member 206 formed thereon that is configured to guide air, received from an air tower, into the ice maker 126. The duct member 206 is shown as being formed integral with the housing cover 200 such that the duct member 206 and the housing cover 200 are formed during a single injection molding process. Alternatively, the duct member 206 may be a separate and distinct element with respect to the housing cover 200 that is subsequently attached thereto after the housing cover 200 is molded.

In a further separate embodiment, the dispenser 122 includes a user interface that switches the functionality of the dispenser 122 between a water mode and an ice mode. Further, the ice mode comprises a crushed ice mode and a regular (i.e., cubed ice) mode. In operation, a user sets a default setting of the user interface such that, after a predetermined time period (e.g. 30 seconds) from the last interaction with the dispenser 122, the settings of the user interface default back to the user default setting. For example, a user sets the default setting to the water mode; if the crushed ice mode is selected and the dispenser 122 dispenses the crushed ice, then the user interface will default back to the water mode after the predetermined time period has passed with respect to the operation of the crushed ice mode.

In yet another separate embodiment, the dispenser 122 includes a drain tube disposed at a water dispenser tray. In operation, if water being dispensed from the dispenser 122 spills out of the receptacle (i.e., a cup) placed therein, then the water is collected by the water dispenser tray. Subsequently, the collected water is drained from the tray via the drain tube and is directed towards another drain tube positioned in the fresh food compartment 102 inner liner 118. Specifically, this second drain tube directs the collected water to an evaporator water tray located at a compressor compartment. This evaporator water tray is used during a defrost cycle. Additionally, the second drain tube may include a heater in order to avoid the solidification of water therein that would block the tube.

Figure 16:
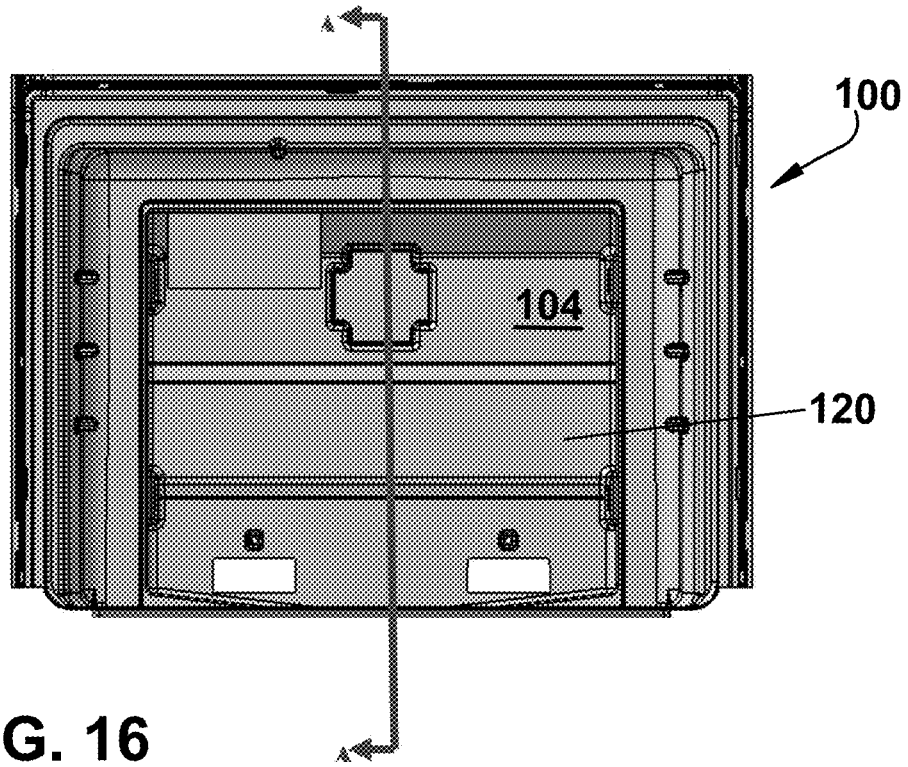
FIG. 16 is partial front view of another embodiment of a top-mount refrigerator.

In yet a further separate embodiment, as shown in FIG. 16, a top mount refrigerator 100 (i.e., a freezer compartment 104 disposed vertically above a fresh food compartment 102) is partially shown. Specifically, the freezer liner 120 of the freezer compartment 104 is shown. An ice maker is configured to be installed to the freezer liner 120. Evaporators associated with the ice maker cool the air surrounding an ice tray. However, if a door of the freezer is opened, then frost may form on the evaporator. It is known to use a heater to remove this frost. The heated frost turns to liquid (i.e., water) and must be drained from the freezer compartment 104.

Figure 17:
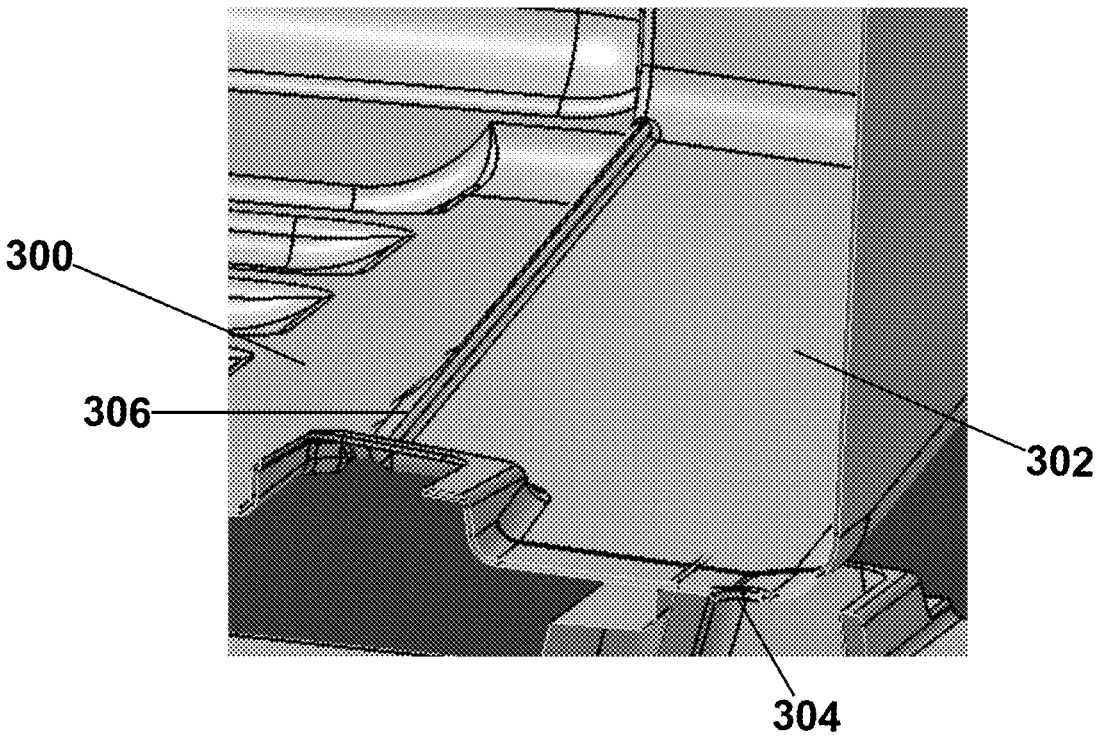
FIG. 17 is a prospective cross-sectional view of a freezer compartment of the refrigerator shown in FIG. 16, taken along the line A-A.

With respect to FIG. 17 (i.e., a cross-sectional view of FIG. 16, taken along line A-A), a bottom surface 300 of the freezer liner 120 is shown as including a recessed sump 302. The recessed sump 302 is formed integral with the freezer liner 120 (i.e., formed simultaneously during a single manufacturing process). Specifically, the recessed sump 202 is provided in a uniform manner across a width (i.e., between opposing sidewalls) of the freezer liner 120 and is configured to collect the liquid (resulting from a phase change of the frost built up on the evaporator) and direct the liquid to a drain hole 304. As further shown, a wall member 306 is provided across the width of the freezer liner 120. Further, the amount that the recessed sump 202 is recessed with respect to the bottom surface 300 of the freezer liner 120 is relatively small. As such, the amount of tool movement during manufacturing is reduced. Further, the amount of liner material needed to stretch in order to form the freezer liner 120 is reduced.

In still a further separate embodiment, a smart ice making cycle is described. Conventional ice makers for existing refrigeration appliances include various elements (e.g., switches, cams, thermistors, thermostats, mechanical levers, etc.) to perform the function of the ice maker. These individual elements will engage when certain conditions (i.e., time and temperature) are met. For example, the ice maker will call for water (either directly or indirectly via an external controller) to fill an ice tray. The water collected in the ice tray will freeze, thereby turning to ice.

The ice maker usually rotates a mechanism to eject the ice. As the device rotates, one or several switches will send a signal and trigger some action with respect to beginning another ice making cycle, or delaying a subsequent ice making cycle. Specifically, when there is enough ice in the ice bin, the ice maker will no longer eject ice, even if ice is frozen in the ice tray. However, when the ice bin is not full, the ice is ejected from the tray, and water is again called to refill the tray and initiate the next ice making cycle.

The smart ice maker, disclosed hereinafter, does not rely on switches, thermostats, thermistors, or time to determine if the ice bin is full and/or if a subsequent ice making cycle should begin. Instead a computer vision system is employed to supervise and control the fundamental steps of the ice making cycle: a fill phase, a freeze phase, and a harvesting phase. The computer vision system comprises a forward looking infrared camera sensor to visualize temperatures for the aforementioned ice making cycle.

In operation, the infrared sensor continuously observes the ice tray, fill cup, or fill tube, and the area in the ice bin wherein the ice accumulates. When it is sensed that the temperature in those areas are below a proper freezing temperature, then a controller calls for water in order to fill the ice tray. While water is flowing, the infrared sensor will sense the higher temperature of the water being introduced into the ice maker as compared to the surrounding environment, thus the controller understands that water is flowing, as expected. As such, the water will continue to flow until it is determined that the ice tray is full.

Subsequently, the water in the ice tray is cooled until it transitions into solid ice. At this point, the computer vision system looks at all the ice pieces individually, and determines the proper time to harvest. When it is determined that the harvesting phase may begin, an ejection mechanism is triggered and ice is ejected from the ice tray and directed to the ice bin. Thereafter, the computer vision system inspects the ice tray to ensure it is empty. If the ice tray is not empty, the controller may initiate a step to remove any leftover ice pieces. If the ice tray is empty, then the ice making cycle is repeated. This continues until the computer vision system detects that the presence of ice within the ice bin is above a specified threshold (i.e., a predetermined height). At such time, the harvesting phase is delayed until the detected level of ice within the ice bin falls below the specified threshold.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A modular water storage tank, for a refrigerator, being in fluid communication between an upstream source and a downstream destination provided at the refrigerator, the modular water storage tank comprising:

a hollow storage body comprising a first body member having first and second open ends that are axially spaced from one another along a longitudinal axis of the first body member, the first and second open ends facing opposite directions with respect to one another, and the first open end comprising a first male extension that extends outwards and away from a central portion of the first body member, the first male extension having a first connection member on an outer surface thereof;

a female end cap comprising a side wall extending outwards and away from a front end wall, wherein an inner surface of the side wall has a second connection member that is configured to engage with the first connection member to secure the female end cap to the first open end when the side wall surrounds the first male extension; and a male end cap comprising a second male extension extending outwards from a rear end wall, the second male extension having a third connection member on an outer surface thereof that is configured to engage with a fourth connection member disposed on an inner surface at the second open end of the first body member to secure the male end cap to the second open end of the first body member when the inner surface at the second open end surrounds the second male extension.

2. The modular water storage tank of claim 1, the first body member being a cylinder having a circular cross-section.

3. The modular water storage tank of claim 2, wherein a diameter of the outer surface of the first male extension and a diameter of the outer surface of the second male extension are the same, and wherein a diameter of the inner surface at the second open end and a diameter of the inner surface of the side wall of the female end cap are the same.

4. The modular water storage tank of claim of claim 1, wherein each of the first and second male extensions has a groove formed in the respective outer surfaces thereof, said groove provided for accepting a sealing member therein.

5. The modular water storage tank of claim 1, wherein the first, second, third, and fourth connection members each comprise bayonet connectors, and the first and third connection members each further comprise a stop and the second and fourth connection members each further comprise a latch configured to engage the respective stops of the first and third connection members to prevent accidental removal of the male and female end caps to the second and first open ends of the first body member, respectively.

6. The modular water storage tank of claim 5, wherein the first and third connection members are identical, and wherein the second and fourth connection members are identical.

7. The modular water storage tank of claim 1, the hollow storage body comprising a second body member that is linearly connected to the first body member to form and increase a size of the hollow storage body.

8. The modular water storage tank of claim 7, the first and second body members being identical.

9. The modular water storage tank of claim 7, the first male extension being configured such that it is sized and shaped to connect with the female end cap or the second open end of the second body member.

10. The modular water storage tank of claim 9, the first and second male extensions being identical.

11. A modular water storage tank, for a refrigerator, being in fluid communication between an upstream source and a downstream destination provided at the refrigerator, the modular water storage tank comprising:

a hollow storage body comprising a cylinder having a central portion with an inner circumferential surface and an outer circumferential surface, the hollow storage body further having first and second open ends that are axially spaced from one another along a longitudinal axis of the hollow storage body, the first and second open ends facing opposite directions with respect to one another, wherein the first open end of the hollow storage body comprises a first male extension that extends outwards and away from the central portion of the hollow storage body, and wherein a diameter of an outer circumferential surface of the first male extension is smaller than a diameter of the outer circumferential surface of the central portion of the hollow storage body;

a first pair of end caps configured to be secured to the first and second open ends of the hollow storage body; and a second pair of end caps configured to be secured to the first and second open ends of the hollow storage body, wherein the first and second pairs of end caps are not secured to the first and second open ends of the hollow storage body at the same time such that an interior storage space is defined within the hollow storage body when only the first pair of end caps or the second pair of end caps is secured to the first and second open ends of the hollow storage body, wherein when only the first pair of end caps is secured to the first and second open ends of the hollow storage body, water is permitted to enter the hollow storage body via the second open end, and the water is permitted to exit the hollow storage body via the first open end, and when only the second pair of end caps is secured to the first and second open ends of the hollow storage body, water is permitted to enter and exit the hollow storage body via only the second open end.

12. The modular water storage tank of claim 11, each of the first and second pairs of end caps comprising a female end cap provided to be secured to the first open end, the female end cap comprising a cylindrical side wall extending outwards and away from a front end wall.

13. The modular water storage tank of claim 12, wherein a diameter of an inner circumferential surface of the cylindrical side wall is greater than the diameter of the outer circumferential surface of the first male extension, such that, when the female end cap is secured to the first open end, the cylindrical side wall circumferentially surrounds the first male extension.

14. The modular water storage tank of claim 13, the first male extension of the hollow storage body having a first groove formed in the outer circumferential surface thereof, the first groove provided for accepting a first sealing member therein that sealingly engages the outer circumferential surface of the first male extension and the inner circumferential surface of the cylindrical side wall of the female end cap.

15. The modular water storage tank of claim 14, each of the first and second pairs of end caps further comprising a male end cap provided to be secured to the second open end of the hollow storage body, the male end cap comprising a rear end wall and a second male extension extending outwards therefrom.

16. The modular water storage tank of claim 15, the second male extension of the male end cap being cylindrical in shape, wherein a diameter of an outer circumferential surface of the second male extension is smaller than a diameter of an inner circumferential surface of the hollow storage body at the second open end, such that, when the male end cap is secured to the second open end, the second male extension is circumferentially surrounded by the hollow storage body at the second open end.

17. The modular water storage tank of claim 16, the second male extension of the male end cap having a second groove formed in the outer circumferential surface thereof, the second groove provided for accepting a second sealing member therein that sealingly engages the outer circumferential surface of the second male extension of the male end cap and the inner circumferential surface of the hollow storage body at the second open end.

18. A modular water storage tank, for a refrigerator, being in fluid communication between an upstream source and a downstream destination provided at the refrigerator, the modular water storage tank comprising:

a hollow storage body having first and second open ends that are axially spaced from one another along a longitudinal axis of the hollow storage body, the first and second open ends facing opposite directions with respect to one another;

a first pair of end caps configured to be secured to the first and second open ends of the hollow storage body; and a second pair of end caps configured to be secured to the first and second open ends of the hollow storage body, wherein the first and second pairs of end caps are not secured to the first and second open ends of the hollow storage body at the same time such that an interior storage space is defined within the hollow storage body when only the first pair of end caps or the second pair of end caps is secured to the first and second open ends of the hollow storage body, wherein when only the first pair of end caps is secured to the first and second open ends of the hollow storage body, water is permitted to enter the hollow storage body via the second open end, and the water is permitted to exit the hollow storage body via the first open end, wherein when only the second pair of end caps is secured to the first and second open ends of the hollow storage body, water is permitted to enter and exit the hollow storage body via only the second open end, and wherein each of the first and second pairs of end caps comprises:

a female end cap provided to be secured to the first open end of the hollow storage body; and a male end cap provided to be secured to the second open end of the hollow storage body, wherein the male end cap of the first pair of end caps has an inlet to permit the water to enter the interior storage space of the hollow storage body via the second open end, and the female end cap of the first pair of end caps has an outlet to permit the water to exit the interior storage space of the hollow storage body via the first open end, and wherein the male end cap of the second pair of end caps has an inlet and an outlet that are provided to permit the water to enter and exit the interior storage space, respectively, via only the second open end.

* * * * *